United States Patent [19]

Poitras et al.

[11] 3,952,918

[45] Apr. 27, 1976

[54] FLUID DISPENSER APPARATUS

[75] Inventors: Edward J. Poitras, Holliston; Edwin W. Wlodyka, Ashland, both of Mass.

[73] Assignee: Highland Laboratories, Ashland, Mass.

[22] Filed: Mar. 18, 1974

[21] Appl. No.: 451,813

[52] U.S. Cl. ..... 222/82; 222/181; 222/383

[51] Int. Cl.[2] ..... B67B 7/24

[58] Field of Search ..... 222/80, 82, 88, 105, 222/181, 183, 185, 383, 386.5, 387, 494, 83, 492, 495, 496

[56] References Cited

UNITED STATES PATENTS

| | | | |
|---|---|---|---|
| 807,985 | 12/1905 | Alden | 222/383 |
| 1,933,192 | 10/1933 | Taylor | 222/88 |
| 2,003,562 | 6/1935 | Stuart | 222/82 |
| 2,241,097 | 5/1941 | Mezzapesa | 222/83 |
| 2,283,529 | 5/1942 | Bobrick | 222/383 |
| 2,605,021 | 7/1952 | Churchill et al. | 222/181 |
| 2,622,539 | 12/1952 | Martin | 222/383 |
| 3,233,411 | 2/1966 | Schubert | 222/183 |
| 3,246,802 | 4/1966 | Fuhrmann | 222/496 |
| 3,415,277 | 12/1968 | Mitchell et al. | 222/386.5 |
| 3,415,425 | 12/1968 | Knight et al. | 222/386.5 |
| 3,580,429 | 5/1971 | Trindle | 222/105 |

FOREIGN PATENTS OR APPLICATIONS

| | | | |
|---|---|---|---|
| 269,668 | 6/1965 | Australia | 222/181 |

*Primary Examiner*—Robert B. Reeves
*Assistant Examiner*—H. Grant Skaggs
*Attorney, Agent, or Firm*—John E. Toupal

[57] ABSTRACT

Disclosed is a container for fluids and a dispenser for use in conjunction therewith. The container comprises a reinforced portion that defines an aperture and a puncturable seal closing the aperture. The dispenser includes a support for receiving and supporting the container in an operative position. When the container is placed in operative position a puncture tube automatically punctures the seal and allows fluid to flow out of the dispenser under control of a manually operated valve.

6 Claims, 5 Drawing Figures

FLUID DISPENSER APPARATUS

BACKGROUND OF THE INVENTION

This invention relates to pumps and more particularly, to hand operated apparatus for dispensing small quantities of fluid.

A myriad of products, ranging from hand lotions to window cleaning compounds, are delivered for use from containers by small hand operated pumps. Some of these pumps, such as those supplied with window cleaning compounds, utilize a dip tube extending below the pump apparatus to draw fluid up to the pump for its exit. Others employ a configuration wherein a fluid containing reservoir is disposed above the pump apparatus. Dispensers of the latter variety are particularly well suited for use as wall mounted soap dispensers in washroom facilities. Since the container is positioned above the pump, location of the pump's outlet directly above a wash basin is facilitated. In addition, the upright container provides the advantages inherent in a gravity aided feed system. Functional disadvantages, however, stem from the procedures required to recharge a given dispenser. To minimize handling, it is desirable to substitute a full container for an empty one rather than refilling the latter. However, since the opening is on the lower side of the reservoir container, the replacement step typically entails a certain amount of spillage which involves both fluid loss and wasteful clean-up operations.

The object of this invention, therefore, is to provide a dispenser apparatus that can be quickly and easily recharged with fluid without any danger of spillage.

SUMMARY OF THE INVENTION

This invention is characterized by the provision of a hand operated pump apparatus for dispensing small quantities of fluid such as soap. A support cup receives a container in an operative position wherein a hollow puncture tube punctures a wall of the container. A hand pump can then be actuated to induce fluid flow out of the container, through the hollow puncture tube and out of an outlet valve. A preferred container includes a seal that is retained by a bottle cap with an aperture to receive the puncture tube. The seal is penetrated by the puncture tube when the container is situated in place. The cap provides a reinforcing system around the seal and prevents inadvertent puncture thereof prior to use. The puncturable seal can be composed of a resilient material that after puncture will form a tight seal around the outer surface of the puncture tube. Since the soap container is sealed until it is finally placed in operative position and only then punctured, there is no possibility of spillage as typically occurs when a soap bottle is inverted and placed on a conventional dispenser pump.

A feature of the invention is the inclusion of an outlet valve through which the soap is expelled from the pump during the dispensing operation. A valve disclosed herein includes an outlet orifice that is covered with a slit retaining pliable cap. The slit in the cap opens in response to internal pressure and closes in response to external pressure as described more fully below. Consequently, the fluid, such as soap, retained near the outlet is not congealed by exposure to air if the dispensing apparatus remains unused for an extended length of time.

Another feature of the invention is the inclusion of a clamp mechanism for the container bottle. The clamp selectively retains the container in its support and prevents unauthorized removal thereof. After the container bottle is inverted and the seal punctured, the clamp mechanism is actuated to grip the bottle cap and thus secure the bottle. Subsequent removal of the bottle requires release of the clamp with a special tool.

Another embodiment described herein includes a reinforced plastic bag container for dispensing pasty substances. The reinforcement allows collapse of the bag toward the pump inlet but prevents lateral collapse. Thus, gravity induces uniform axial collapse of the bag as it empties and none of the pasty substance becomes trapped in cavities displaced laterally from the pump inlet.

DESCRIPTION OF THE DRAWINGS

These and other features and objects of the present invention will become more apparent upon a perusal of the following description taken in conjunction with the accompanying drawing wherein.

DESCRIPTION OF THE PREFERRED EMBODIMENTS

Figure 1:
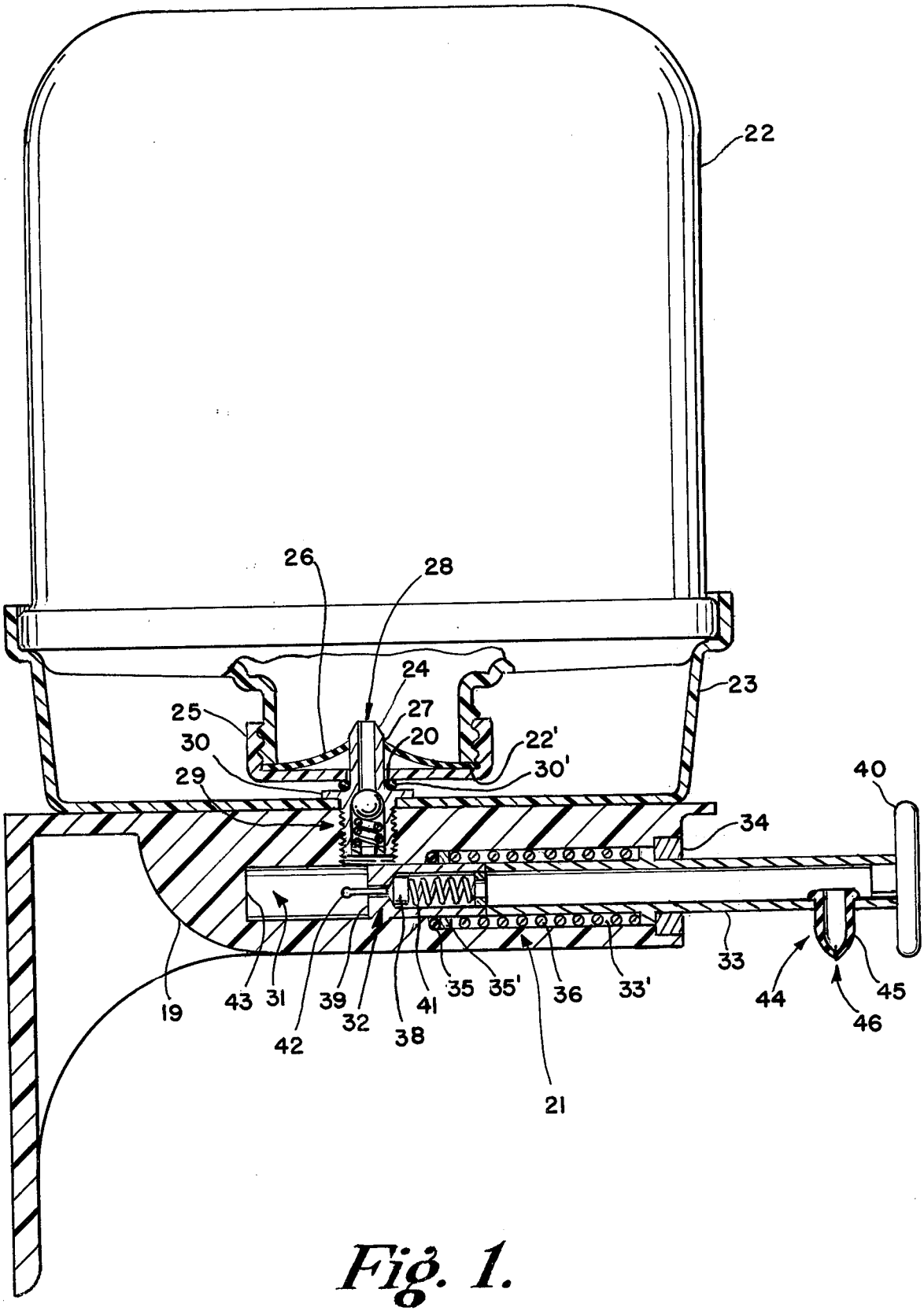
FIG. 1 is a cross-sectional elevation view of a preferred fluid dispenser.

Referring first to FIG. 1 there is shown a hand operated pump 21 for dispensing small quantities of fluid from a container bottle 22. Supporting the bottle 22 is a support cup 23 mounted on a base member 19. With the bottle 22 in the operative position shown in FIG. 1 a puncture tube 24 threadedly retained by the base 19 passes through an aperture 20 in a bottle cap 25. A gasket seal 26 is seated between the inner surface of the bottle cap 25 and the top edge 22' of the bottle 22 in the conventional manner. The cap 25 both retains the seal 26 and prevents inadvertent puncture thereof prior to the time of intended use. Preferably, the seal 26 is made of resilient material and remains in sealing engagement with an outer seal surface 27 of the puncture tube 24. In addition, the aperture 20 in the bottle cap 25 is sealed by an O-ring 30' seated between the outer surface of the cap 25 and a shoulder 30 formed on the tube 24. Thus, all fluid flowing from the bottle 22 must pass through a passage 28 extending through the puncture tube 24.

Mounted in the tube 24 is a spring loaded check valve 29 that closes the passage 28. The valve 29 only permits the passage of fluid if the pressure within the bottle 22 exceeds the pressure in a cylindrical chamber 31 formed in a base 19 and communicating with the passage 28. One wall of the chamber 31 is formed by a spring loaded valve 32 that is bonded to the end of a hollow tubular piston 33 having an opposite end closed by a handle 40. Accommodating the piston 33 in the base 19 is a counter bore 33' coaxial with the chamber 31. The piston 33 passes through a retaining ring 34 pressed into an accommodating recess in the base 19 and an inner O-ring 35 retained between a shoulder formed by the counter bore 33′ and a washer 35′. Extending between the washer 35′ and an annular boss 37 on the piston 33 is a spring 36 that urges the piston toward the right as viewed in FIG. 1. The valve 32 comprises a pressure responsive valve member 38 that opens when the pressure in the chamber exceeds, by a predetermined level, the pressure in the hollow piston 33. The opening pressure required is determined by a spring 41 that resists movement of the valve member 38. Further valve control, however, is provided by a pin 42 that extends from the valve member 38 beyond the end 39 of the valve body 32. As the piston 33 is moved inwardly, the pin 42 engages an end wall 43 of the chamber 31 and forces the valve 32 to open regardless of pressure in the chamber 31.

An outlet orifice 44 in the piston 33 is plugged by a pliable rubber cap 45 with a slit 46 in the lower surface thereof. The cap 45 acts as an outlet valve and opens to relieve pressure within the piston 33 caused by fluid flow thereinto through the valve 32. Air is allowed to enter the bottle 22 during use through a pin hole (not shown) punched through the bottom thereof.

To use the dispenser 21, a bottle 22 previously filled with a suitable fluid soap, for example, is inverted and placed in the operative position within the support 23. At that time the puncture tube 24 passes through the gasket seal 26. However, fluid flow into the chamber 31 is prevented by the check valve 29. The handle 40 and, accordingly, the piston 33 are then pressed toward the left as viewed in FIG. 1 compressing the air in the chamber 31. When the pin 42 strikes the wall 43 the valve member 38 opens and the pressure in the chamber 31 is relieved. As the handle 40 is allowed to return under the influence of the spring 36, a partial vacuum is created in the chamber 31. When the handle 40 nearly reaches the position shown in FIG. 1, the passage between the chamber 31 and the check valve 29 is opened, the low pressure in the chamber 31 allows the valve 29 to open and atmospheric pressure in the bottle 22 forces a measured amount of fluid soap into the chamber 31. When the handle 40 is again pressed to the left, the resultant fluid pressure in the chamber 31 opens the pressure responsive valve member 38 and the moving surface 39 forces fluid through the valve 32 into the hollow piston 33. Each subsequent reciprocal movement of the handle 40 similarly induces first an emptying and then a filling of chamber 31. After several such actuations, the interior of the piston 33 is filled and further influx of fluid through the valve 32 produces a fluid discharge out of the piston 33 through the outlet valve 45. When this operating condition is reached, each depression and release of the handle 40 causes a measured amount of fluid to flow from the outlet valve 45.

During this pumping operation, the valve member 38 and the pin 42 function to prevent discharged fluid from accumulating on the outer surface of the outlet valve 45. Consequently, a tidy appearance is more easily maintained and unwanted dripping from the valve 45 is prevented. These functions are provided by the pin 42 which induces a transient reverse pumping action at the completion of each positive pump stroke by the piston 33. As described above, contact between the pin 42 and the wall surface 43 maintains the valve member 38 open regardless of the pressure in the chamber 31. Thus, after each complete pump stroke, the valve member remains open during initial outward motion of the piston 33. The partial vacuum created during this period draws fluid from the hollow piston into the chamber 31. This action continues only until the pin moves out of contact with the surface 43. Thus, at the completion of each pump stroke a metered quantity of fluid is returned from the hollow piston 33 to the chamber 31 producing suction at the outlet slit 46 and thereby preventing the above-noted external accumulation of fluid.

Figure 2:
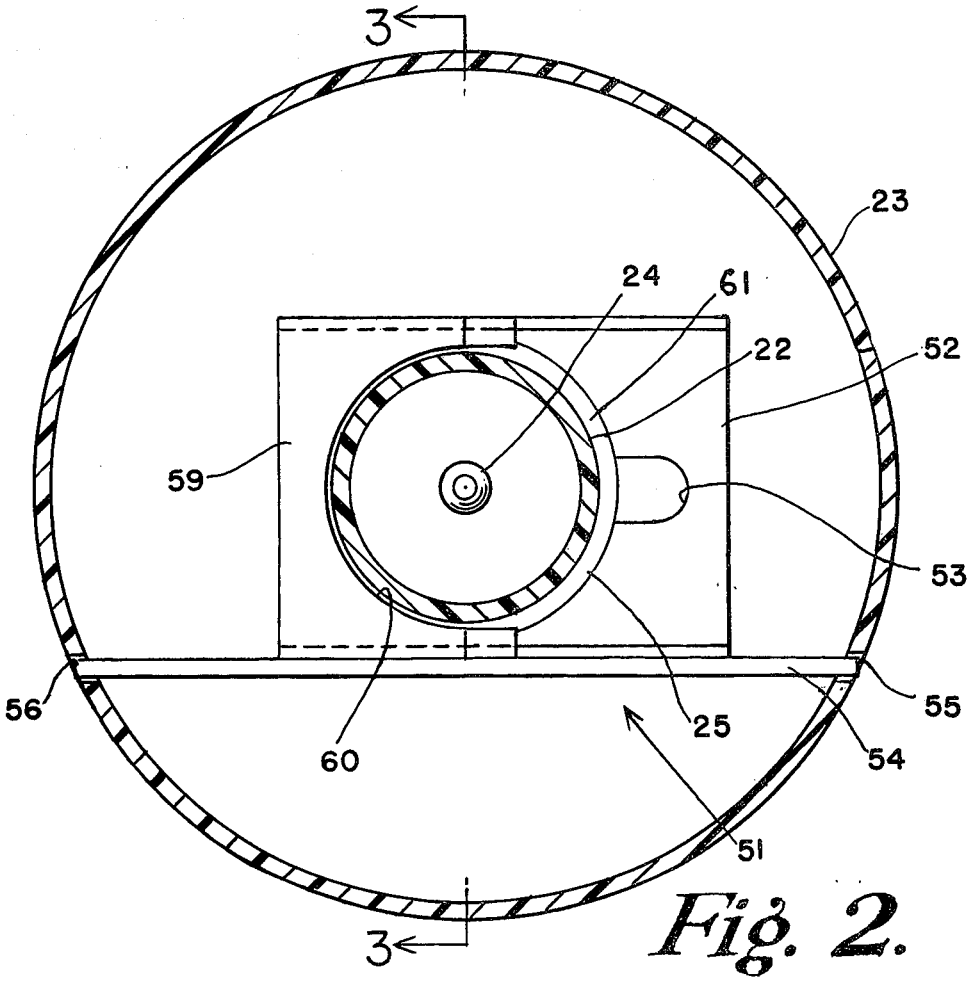
FIGS. 2 and 3 are cross-sectional plan and elevation views, respectively, of a clamp apparatus that can optionally be employed with the dispenser shown in FIG. 1.
Figure 3:
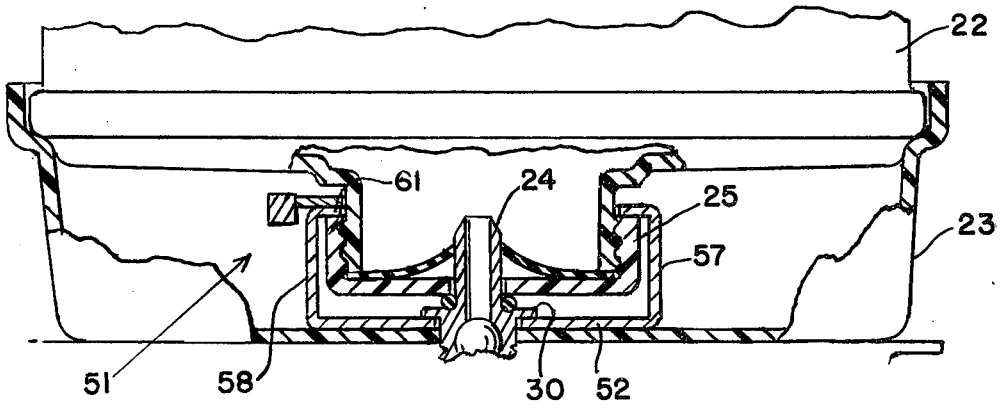

Referring now to FIGS. 2 and 3 there is shown an optional clamp apparatus 51 that can be utilized in conjunction with the subject dispenser. A plate 52 is retained between the shoulder 30 on the puncture tube 24 and the support cup 23. The puncture tube 24 passes through an elongated slot 53 in a plate 52 so as to allow sliding movement thereof. An elongated actuator rod 54 passes through two openings 55 and 56 in the support cup 23. Vertical side walls 57 and 58, extending from the plate 52, terminate in a transverse support plate 59 with a U-shaped notch 60 therein. The U-shaped notch 60 surrounds and extends over the edge 61 on the bottle cap 25 as shown in FIGS. 2 and 3.

To remove the bottle 22, the actuator 54 is pressed to the left (as viewed in FIG. 2) by an external tool (not shown) that passes through the opening 55. Thus, the plate 52 moves to the left, and the bottle cap 25 is released. After a new bottle 22 has been located in place, the end of the actuator rod 54, protruding from the opening 56 is depressed until it is flush with the outer surface of the support cup 23. When that is done, the U-shaped plate 59 is again in the position shown in FIGS. 2 and 3 and the bottle cap 25 is securely retained. Furthermore, with the clamping mechanism 51 in that position, the actuator rod 55 is concealed within the cup 23 and can be moved into release position only by a tool fitting through the opening 55. Thus, the possibility of having the bottle 22 removed by unauthorized personnel is substantially reduced.

Figure 4:
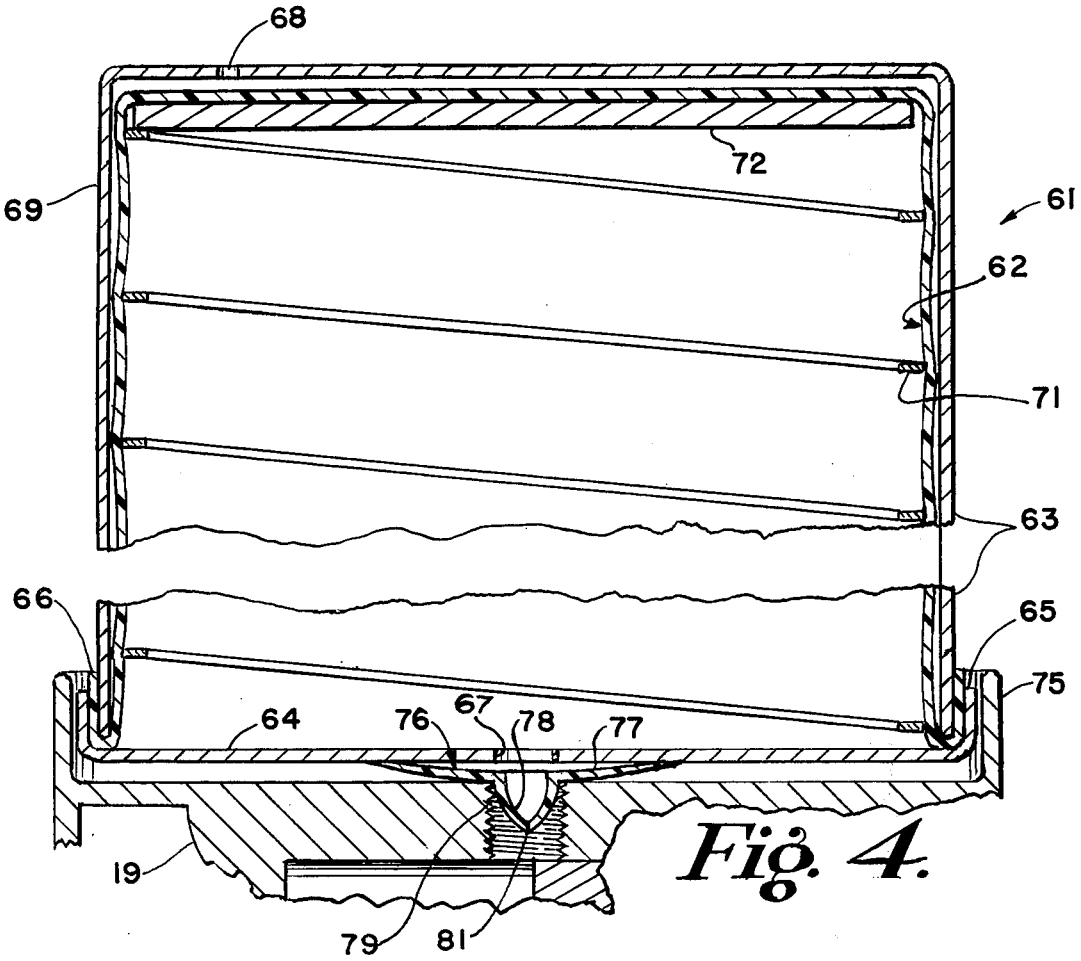
FIG. 4 is a cross-sectional elevation view of an alternate fluid container apparatus.

Referring now to FIG. 4 there is shown another container embodiment 61 mounted on the base member 19 shown in FIG. 1. A substance to be dispensed is contained by a flaccid bag 62 made, for example, of plastic. Preferably the bag 62 is filled with a pliable substance such as pasty soap. Enclosing the bag 62 is a cylindrical can 63 with a cover 64 having an annular skirt portion 65. A marginal portion 66 along an open end of the bag 62 is retained between the outer surface of the can 63 and the inner surface of the annular skirt portion 65. Centrally located in the cover 64 is a discharge opening 67 while opposite thereof is a vent opening 68 extending through a top wall 69 of the can 63. A reinforcing cylindrical coil member 71 is axially aligned with the opening 67 and contacts the inner surface of the bag 62. The coil member 71 made, for example, of plastic is easily collapsible axially but is resistant to collapse radially and integrally with the bag 62. Also retained within the bag 62 is a circular disc 72 located directly adjacent the end of the bag opposite the discharge opening 67.

Figure 5:
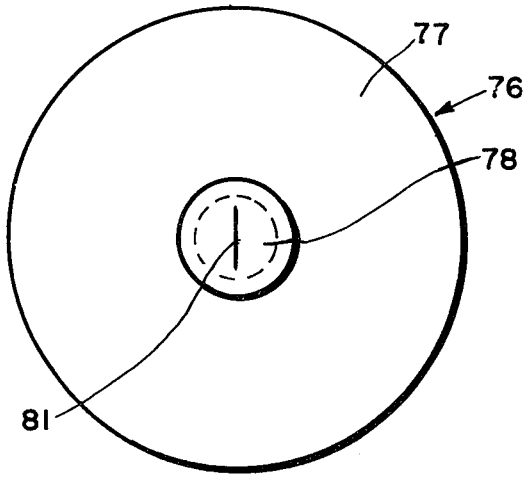
FIG. 5 is an enlarged bottom view of a seal cup utilized with the dispenser of FIG. 4.

The can 63 is supported by the base 19 and is retained thereon by an annular, vertically extending rim 75. The remainder of the base member 19 is identical to that shown in FIG. 1 except that the check valve 29 is replaced in embodiment 61 by a cup member 76 shown also in FIG. 5 and formed, for example, of a suitable elastomeric material. The cup member 76 comprises a semispherically shaped seal portion 77 joined centrally with a hollow nozzle portion 78 that is press fitted into a threaded opening 79 in the base member 19. A slit 81 provides a discharge opening in a lower conically shaped portion of the nozzle 78.

During use of the embodiment 61, a soap filled bag 62 is inserted into the opened can 63 which is then closed by the cover 64 as shown in FIG. 4. As the can 63 is positioned on the base member 19, an air seal is formed around the opening 67 between the cover 64 and the semispherical seal portion 77. Manipulation of the pump 21 as described above in connection with FIG. 1 produces a vacuum pressure that draws soap through the discharge opening 67 and the slit 81 into the pump chamber 31 from which it can be dispensed. As the contents of the bag 62 are depleted, atmospheric pressure insured by the vent opening 68 causes collapse of the bag 62. Because of the coil member 71, however, this collapse progresses uniformly in a vertical direction toward the discharge opening 67 since horizontal collapse is prevented by the axial rigidity of the coil member 71. Consequently, no sidewall portion of the bag 62 is allowed to reach and thereby seal the discharge opening 67. In addition, the shield disc 72 prevents the end wall of the flexible bag 62 from reaching the opening 67. Thus, the opening 67 is maintained open to insure that the entire contents of the bag 62 are emptied.

Obviously, many modifications and variations of the present invention are possible in light of the above teachings. It is to be understood, therefore, that the invention can be practiced otherwise than as specifically described.

What is claimed is:

1. A manually operated pump apparatus for dispensing fluids from a container and comprising:

support means for receiving and supporting the container in an operating position;

puncture means for automatically puncturing the surface of the container in response to movement thereof into the operative position;

passage means for receiving fluid through an opening in the container;

pump means coupled to said passage means for receiving fluid therefrom, said pump means comprising chamber means for receiving a measured amount of fluid from said passage means, outlet means for draining said chamber means during operation of said pump means, and a hand operated piston means hollow thru-out its length with one end that defines a movable wall of said chamber means and a portion spaced from said one end and supporting said outlet means; and valve means positioned between said chamber means and said hollow piston means said outlet means comprising an outlet valve, opening in response to pressure in said hollow piston, spring bias means biasing said valve means closed and wherein said valve means comprises pressure release means for opening said valve means in response to a given differential pressure between said chamber and said hollow piston means sufficient to overcome said spring bias means and further comprises mechanical release means for opening said valve means at a predetermined position in the cycle of operation of said pump.

2. A device according to claim 1 including seal means for insuring that all fluid passing through the puncture enters said passage means.

3. A device according to claim 1 wherein said outlet valve comprises a pliable slit retaining cap.

4. A device according to claim 1 including clamp means for releasably holding the container in said support means, a clamp actuator means for releasing said clamp means, and means concealing said clamp actuator means.

5. A device according to claim 1 wherein said container comprises reinforcement means defining an aperture therethrough; and puncturable seal means spanning said aperture and adapted to be punctured by said puncture means and to allow escape of the fluid in the container through said passage means.

6. A device according to claim 5 wherein said container comprises a bottle and said reinforcement means comprises a bottle cap.

* * * * *